US007969124B2

(12) United States Patent
Matsuda

(10) Patent No.: US 7,969,124 B2
(45) Date of Patent: Jun. 28, 2011

(54) POWER SUPPLY APPARATUS, TEST APPARATUS, AND ELECTRONIC DEVICE

(75) Inventor: Mineki Matsuda, Tokyo (JP)

(73) Assignee: Advantest Corporation, Tokyo (JP)

( * ) Notice: Subject to any disclaimer, the term of this patent is extended or adjusted under 35 U.S.C. 154(b) by 391 days.

(21) Appl. No.: 11/756,635

(22) Filed: Jun. 1, 2007

(65) Prior Publication Data

US 2008/0297121 A1 Dec. 4, 2008

(51) Int. Cl.
*G05F 1/00* (2006.01)

(52) U.S. Cl. ..... 323/220

(58) Field of Classification Search ..... 323/220, 323/223, 224, 234, 265, 266, 276, 299, 282; 324/537, 605, 750, 763
See application file for complete search history.

(56) References Cited

U.S. PATENT DOCUMENTS

| | | | | |
|---|---|---|---|---|
| 3,683,260 | A * | 8/1972 | Kroger et al. | 363/36 |
| 3,780,219 | A * | 12/1973 | O'Toole | 348/654 |
| 3,923,403 | A * | 12/1975 | Harklau | 356/432 |
| 4,514,702 | A * | 4/1985 | Zogg | 330/254 |
| 4,520,416 | A * | 5/1985 | Karash | 361/11 |
| 4,591,781 | A * | 5/1986 | Larson | 323/323 |
| 4,774,480 | A * | 9/1988 | Sato et al. | 331/1 A |
| 5,030,922 | A * | 7/1991 | Rumreich et al. | 330/253 |
| 5,331,270 | A * | 7/1994 | Nutz et al. | 323/237 |
| 5,504,667 | A * | 4/1996 | Tanaka et al. | 363/37 |
| 5,600,552 | A * | 2/1997 | McCavit et al. | 363/89 |
| 6,181,120 | B1 * | 1/2001 | Hawkes et al. | 323/282 |
| 6,735,064 | B2 * | 5/2004 | Miyazaki | 361/58 |
| 6,914,789 | B2 * | 7/2005 | Kinoshita et al. | 363/21.12 |
| RE38,906 | E * | 12/2005 | Hawkes et al. | 323/282 |
| 6,996,489 | B2 * | 2/2006 | Sakaguchi | 702/110 |
| 7,012,825 | B2 * | 3/2006 | Nielsen | 363/142 |
| 7,040,450 | B2 * | 5/2006 | Nagase et al. | 180/443 |
| 7,106,607 | B2 * | 9/2006 | Nielsen | 363/142 |
| 7,330,024 | B2 * | 2/2008 | Hashimoto | 324/158.1 |
| 7,414,822 | B2 * | 8/2008 | Hosaka et al. | 361/139 |
| 7,483,799 | B2 * | 1/2009 | Sakaguchi | 702/76 |
| 7,550,955 | B2 * | 6/2009 | Agari | 323/268 |
| 2008/0297121 | A1 * | 12/2008 | Matsuda | 323/220 |

FOREIGN PATENT DOCUMENTS

JP 2006-105620 4/2006

* cited by examiner

*Primary Examiner* — Adolf Berhane
*Assistant Examiner* — Yemane Mehari
(74) *Attorney, Agent, or Firm* — Chen Yoshimura LLP

(57) ABSTRACT

There is provided a power supply apparatus including a power supply section that supplies an output current to an external load, and a current control section that flows an electric current varying in a direction opposite to a supply current being supplied to the power supply section into a ground of the power supply section.

10 Claims, 10 Drawing Sheets

POWER SUPPLY APPARATUS, TEST APPARATUS, AND ELECTRONIC DEVICE

BACKGROUND

1. Technical Field

The present invention relates to a power supply apparatus, a test apparatus, and an electronic device. More particularly, the present invention relates to a power supply apparatus, a test apparatus, and an electronic device that controls current variation in a ground of a power supply section for supplying a power supply current to a device under test.

2. Related Art

In a device under test (DUT) including an electronic circuit such as a semiconductor device, densification, speeding up, and voltage lowering have been recently performed, and thus allowance for fluctuation of a power supply voltage and a power supply current has been narrow. Therefore, in order to raise the precision of a test result, a test apparatus for testing a device under test requires a power supply apparatus in which the fluctuation of a power supply voltage and a power supply current is small. In regard to the fluctuation of a power supply voltage, a power supply apparatus that can supply a stable power supply voltage to a device under test is disclosed, for example, in Japanese Patent Application Publication 2006-105620.

Here, for example, a test apparatus for performing a test such as an operating characteristic test on a device under test supplies a power supply current and a test signal to the device under test. When the power supply current is supplied to the device under test and an internal electronic circuit operates, a power supply current value being supplied from a power supply section in the test apparatus is changed in accordance with operational conditions.

However, when the power supply current value being supplied from the power supply section in the test apparatus is changed, a return current value in a ground of the power supply section in the test apparatus is also changed. If the fluctuation of the return current value in the ground of the power supply section in the test apparatus becomes large, since GND may vary and the power supply current value being supplied from the power supply section may be unstable, the precision of a test result may decrease in some cases.

SUMMARY

Therefore, it is an object of some aspects of the present invention to provide a power supply apparatus, a test apparatus, and an electronic device that can solve the foregoing problems. The above and other objects can be achieved by combinations described in the independent claims. The dependent claims define further advantageous and exemplary combinations of the present invention.

That is, according to the first aspect of the present invention, there is provided a power supply apparatus. The power supply apparatus includes: a power supply section that supplies an output current to an external load; and a current control section that flows an electric current varying in a direction opposite to a supply current being supplied to the power supply section into a ground of the power supply section.

The summary does not necessarily describe all necessary features of the present invention. The present invention may also be a sub-combination of the features described above.

DESCRIPTION OF EXEMPLARY EMBODIMENTS

The embodiments of the invention will now be described based on the preferred embodiments, which do not intend to limit the scope of the present invention, but just exemplify the invention. All of the features and the combinations thereof described in the embodiment are not necessarily essential to the invention.

Figure 1:
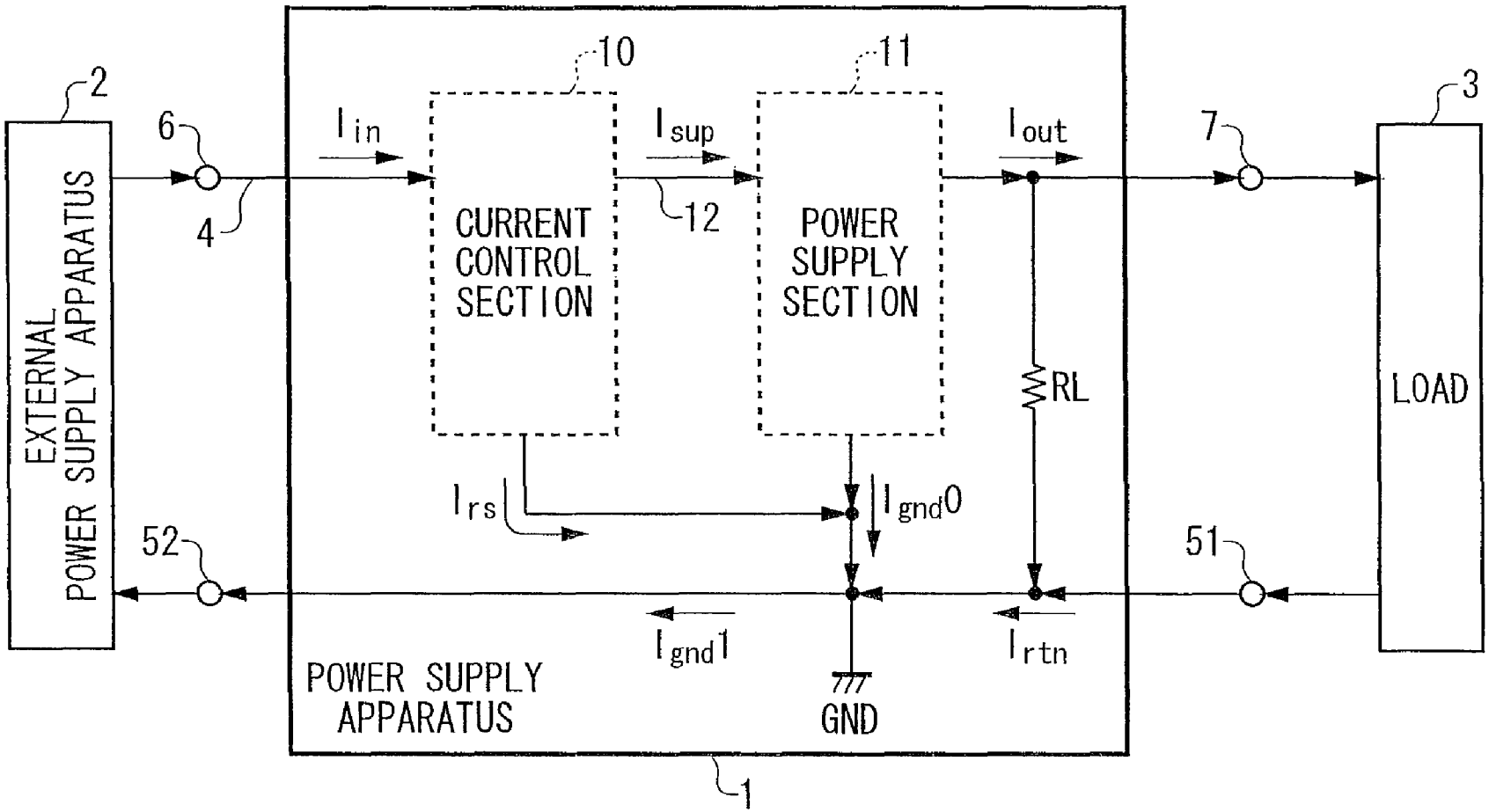
FIG. 1 shows a schematic configuration of a power supply apparatus 1 including a peripheral apparatus thereof according to Embodiment 1.

FIG. 1 shows a schematic configuration of a power supply apparatus 1 including a peripheral apparatus thereof according to Embodiment 1. The power supply apparatus 1 is connected to an external power supply apparatus 2 via an external current input terminal 6 and an external power supply side GND terminal 52. Moreover, the power supply apparatus 1 is connected to a load 3 via an output current output terminal 7 and a load side GND terminal 51. The external power supply apparatus 2 is a main power supply apparatus that supplying a large external current Iin to the power supply apparatus 1 in order to operate the power supply apparatus 1. The load 3 is, e.g., an electronic circuit, and executes a process determined by specification after inputting an output current Iout.

The power supply apparatus 1 includes a current control section 10 and a power supply section 11. The current control section 10 inputs the external current In from the external power supply apparatus 2 via the external current input terminal 6 and an external current line 4, and outputs a supply current Isup to the power supply section 11 via a current supplying line 12. Moreover, the current control section 10 outputs an analog compensating current Irs varying in a phase with polarity opposite to that of the supply current Isup being supplied to the power supply section 11 to a ground GND of the power supply section 11. The power supply section 11 is, e.g., a pressure-rising DC-DC converter. The power supply section 11 inputs the supply current Isup from the current control section 10, and supplies the output current Iout to the load 3. Moreover, the power supply section 11 outputs a ground current Ignd0 to the ground GND. A load resistance RL, for example, attenuates a signal output and adjusts it.

Figure 2:
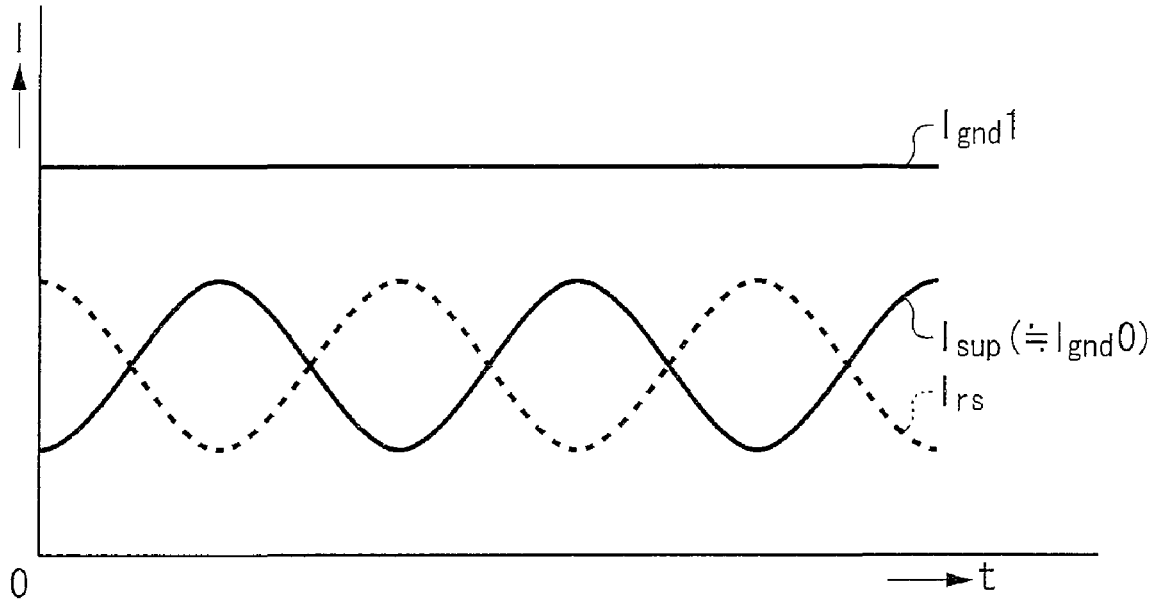
FIG. 2 is a graph showing the fluctuation of GND currents within the power supply apparatus 1 shown in FIG. 1.

FIG. 2 is a graph showing the fluctuation of GND currents within the power supply apparatus 1 shown in FIG. 1. In the graph of FIG. 2, a horizontal axis is a time t and a vertical axis is a current value I. The power supply section 11 is, e.g., a pressure-rising DC-DC converter, and consumes a large current in comparison to the load 3 in order to supply a stable power supply voltage to the load 3. For this reason, most of the supply current Isup is consumed in the power supply section 11, and flows into the ground GND as the ground current Ignd0. Moreover, the output current Iout supplied to the load 3 among the supply current Isup flows from the load 3 to the ground GND via the load side GND terminal 51. From here onwards, the supply current Isup and ground current Ignd0+feedback current Irtn are equal as long as electric currents do not flow from the load 3 to an outside of the load 3, and the supply current Isup and ground current Ignd0+ feedback current Irtn are approximately equal when the electric currents flow into the outside. Here, since the current control section 10 supplies the compensating current Irs, which varies in a phase opposite to the supply current Isup as described above, to the ground GND, a ground current Ignd1 obtained by adding the ground current Ignd0 and the feedback current Irtn to the compensating current Irs can have an approximately steady value.

In this manner, since the power supply apparatus 1 according to Embodiment 1 adds the compensating current Irs varying in an antiphase to the ground GND of the power supply section 11 when the fluctuation of the ground current Ignd0 (a return current value) at the ground GND of the power supply section 11 is large, the ground current Ignd1 can constantly have an approximately steady value. According to this, the power supply apparatus 1 can stabilize the output current Iout being supplied from the power supply section 11 in order to raise the precision of a test result of the electronic circuit.

Figure 3:
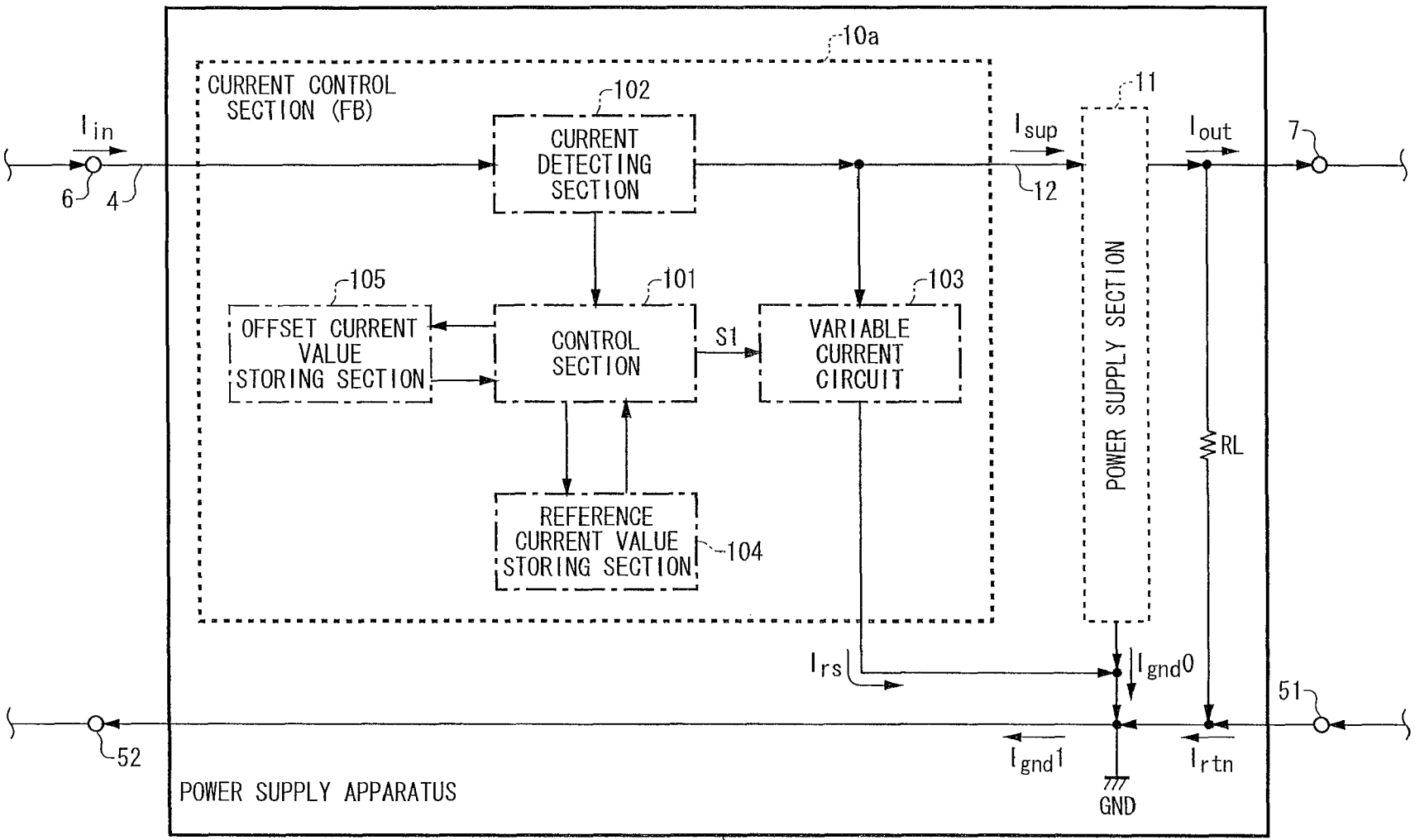
FIG. 3 shows a further detailed configuration of the power supply apparatus 1 when the power supply apparatus 1 shown in FIG. 1 controls electric currents in a configuration of a feedback method.

FIG. 3 shows a configuration of the power supply apparatus 1 when the power supply apparatus 1 has a feedback method. A current control section 10*a* of the power supply apparatus 1 includes a control section 101, a current detecting section 102, a variable current circuit 103, a reference current value storing section 104, and an offset current value storing section 105. The current detecting section 102 detects an external current Ein being supplied from the external power supply apparatus 2 connected to the power supply apparatus 1. The current detecting section 102, for example, connects a resistor with a known resistance value between the external current line 4 and the current supplying line 12 and measures a voltage value on both ends thereof, in order to compute a current value. The variable current circuit 103 is connected between the current supplying line 12 for supplying the supply current Isup to the power supply section 11 and the ground GND of the power supply section 11. The variable current circuit 103 outputs the compensating current Irs from the current supplying line 12 to the ground GND of the power supply section 11. Therefore, the variable current circuit 103 may be a current driving circuit of a constant voltage source for outputting the compensating current Irs. The control section 101 outputs a control signal S1 for controlling the compensating current Irs, which is flowed by the variable current circuit 103 from the current supplying line 12 to the ground GND of the power supply section 11. The control section 101 controls the external current Ein so that the external current Iin detected by the current detecting section 102 in accordance with the control signal S1 approaches the preset reference current Iref. Here, the compensating current Irs is an electric current (Iin-Iref) obtained by subtracting the reference current Iref from the input external current Iin.

The reference current value storing section 104 stores the reference current Iref. The reference current Iref, for example, may be a fixed value determined from a value of the ground current Ignd1 measured in the sample power supply apparatus 1, or may be a value being varied by the control section 101. The offset current value storing section 105 stores a reference offset current Iofs. The reference offset current Iofs, for example, may be a fixed value determined from a maximum value (MAX) of the supply current Isup measured in the sample power supply apparatus 1, or may be a value being varied by the control section 101.

Figure 4:
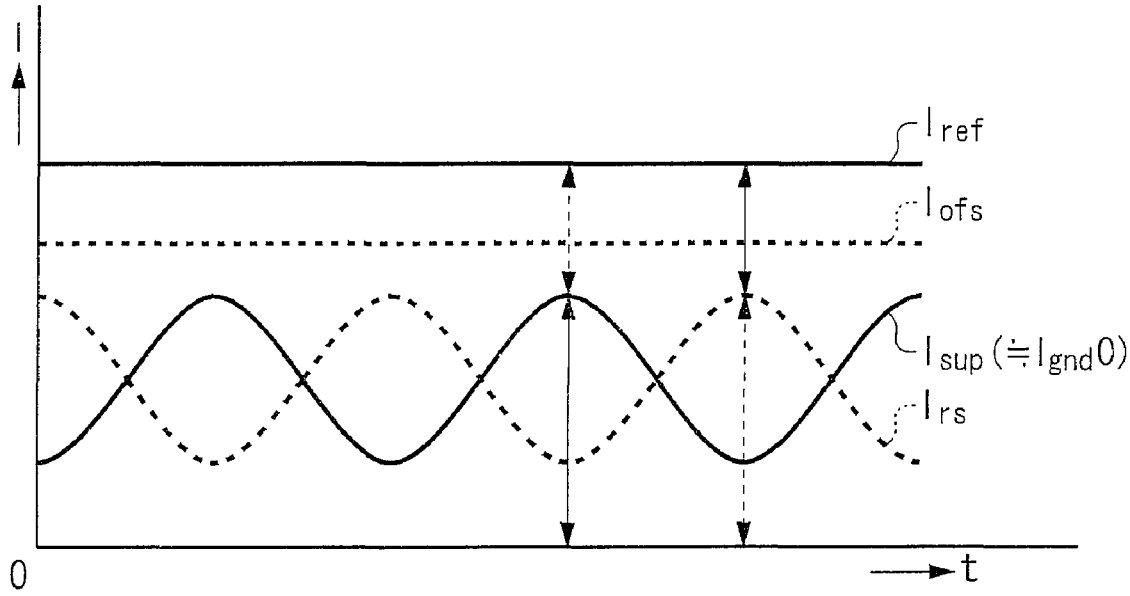
FIG. 4 is a graph showing the fluctuation of a ground current and a compensating current in the power supply apparatus 1 shown in FIG. 3.
Figure 5A:
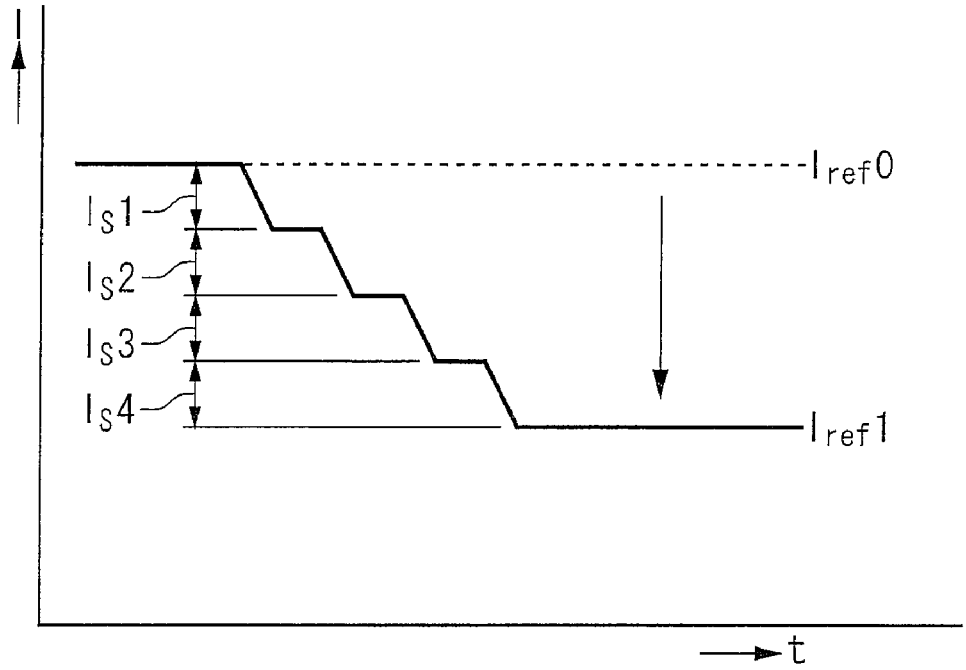
FIGS. 5A and 5B are graphs showing a change of a reference current in the power supply apparatus 1 shown in FIG. 3.
Figure 5B:
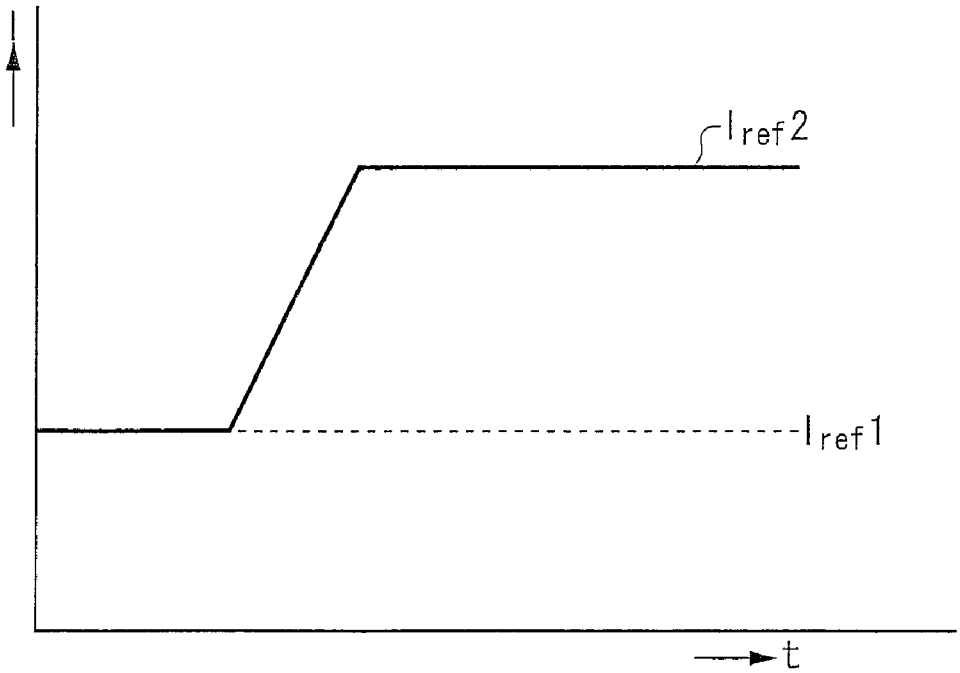

FIG. 4 is a graph showing the fluctuation of the ground current Ignd0 and the compensating current Irs in the power supply apparatus 1 shown in FIG. 3. FIGS. 5A and 5B are graphs showing a change of the reference current in the power supply apparatus 1 shown in FIG. 3. As shown in FIG. 4, the control section 101 can judge that the supply current Isup is in a steady state and the compensating current Irs flowing into the variable current circuit 103 is excessive when a value obtained by subtracting the supply current Isup from the reference current Iref is larger than the preset reference offset current Iofs for a predetermined period. Thus, on condition that "the reference current Iref−the supply current Isup>the reference offset current Iofs", the control section 101 can decrease the reference current Iref from Iref0 to Iref1 as shown in FIG. 5A in order to decrease the compensating current Irs. When decreasing the reference current from Iref0 to Iref1, the control section 101 may gently decrease the reference current without suddenly decreasing the reference current. Therefore, the control section 101 sets the reference current by multiple times in order to reduce the reference current Iref in incremental steps by a predetermined step size Is1, Is2, Is3, Is4, or the like.

Here, the above predetermined period is a time enough to surely detect a value obtained by subtracting the supply current Isup from the reference current Iref, and can be obtained by, e.g., an experiment. The supply current Isup in this case is basically a maximum value (MAX) of the supply current Isup, and the reference offset current Iofs is set to a value satisfying an equation "the maximum value (MAX) of the reference current Iref−the supply current Isup>the reference offset current Iofs". The reference offset current Iofs may be set to, e.g., a value satisfying an equation "a mean value of the reference current Iref−the supply current Isup>the reference offset current Iofs" by using a mean value in place of the maximum value (MAX) of the supply current Isup.

On the other hand, when a value obtained by subtracting the supply current Isup from the reference current Iref becomes smaller than the preset reference offset current Iofs, the control section 101 can judge that the supply current Isup comes off from a steady state. In that case, on condition that the reference current Iref−the supply current Isup≦the reference offset current Iofs, the control section increases the reference current Iref as shown in FIG. 5B. In addition, when decreasing and increasing the reference current Iref, the reference offset current Iofs may not have the same value but have the different value.

In this manner, the power supply apparatus 1 according to the present embodiment can decrease the reference current Iref to decrease a consumption current.

Figure 6:
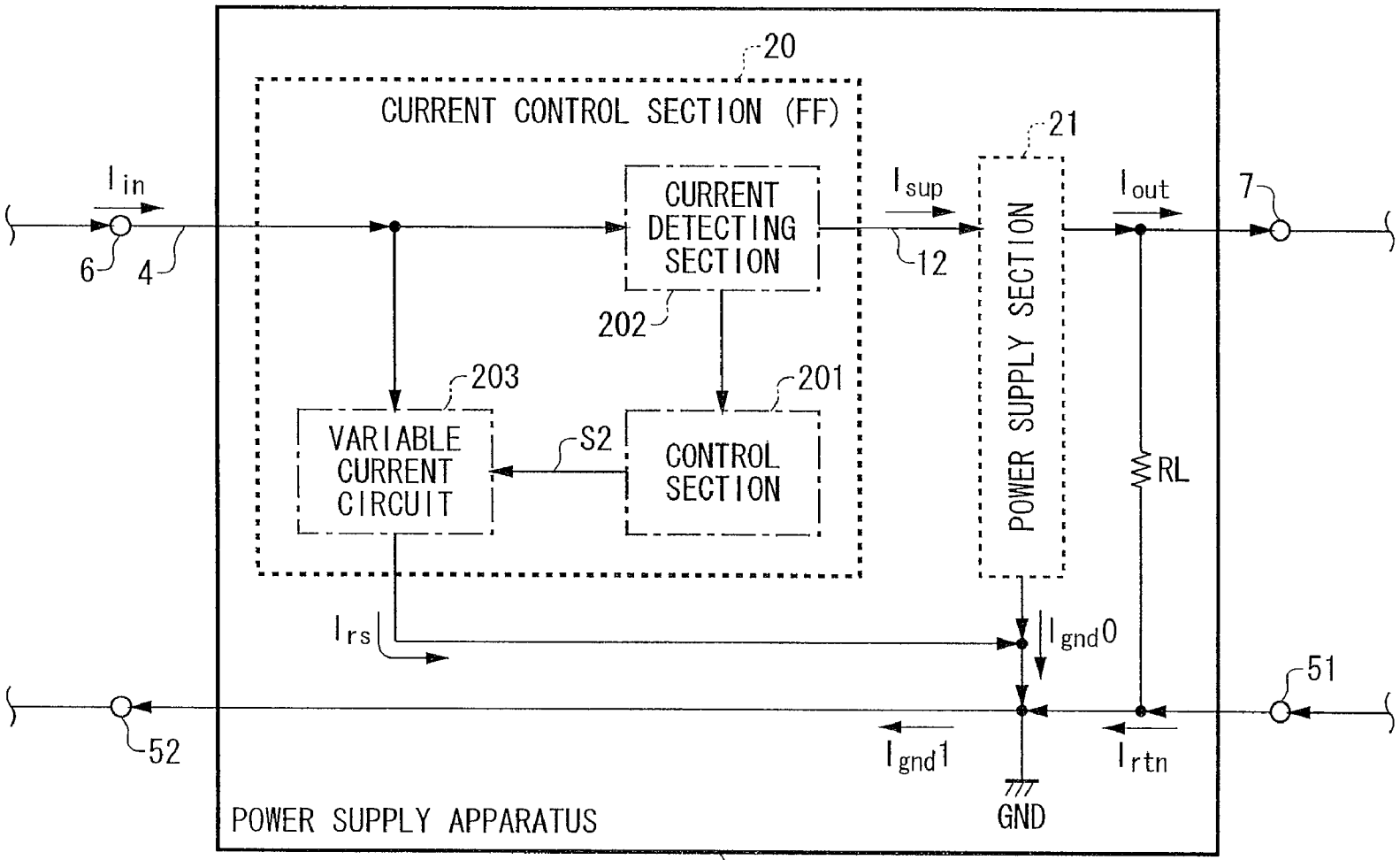
FIG. 6 shows a further detailed configuration of the power supply apparatus 1 when the power supply apparatus 1 shown in FIG. 1 controls electric currents in a configuration of a feed-forward method.

FIG. 6 shows a configuration of a power supply apparatus 1 when the power supply apparatus 1 has a feed-forward method as the first alternative example. The power supply apparatus 1 of the present alternative example includes a current control section 20 and a power supply section 21. The current control section 20 has a current detecting section 202, a variable current circuit 203, and a control section 201. The current detecting section 202 detects the supply current Isup being output to the power supply section 21. The variable current circuit 203 is connected between the external current line 4 for supplying the external current Ein being supplied from the external power supply apparatus 2 and the ground GND of the power supply section 21. The variable current circuit 203 outputs the compensating current Irs to the ground GND of the power supply section 21. The control section 201 outputs a control signal S2 for controlling the compensating current Irs flowed by the variable current circuit 203 from the external current line 4 to the ground GND of the power supply section 21. The control section 201 performs a control operation so that a current value of the compensating current Irs approaches a current value of the supply current Isup detected by the current detecting section 202 in accordance with the control signal S2. Here, the compensating current Irs is an electric current with a phase opposite to that of the supply current Isup, and flows from the external current input terminal 6 to the ground GND.

In this manner, the power supply apparatus 1 according to the present alternative example can stabilize the output current Iout being supplied from the power supply section 11 similarly to a feedback method and thus raise the precision of a test result. Moreover, as shown in FIG. 4 and FIG. 5, when a reference current and a reference offset current are determined and a difference between the reference current and a supply current is obtained, a consumption current may be also decreased by decreasing the reference current if the difference is larger than the reference offset current.

Figure 7:
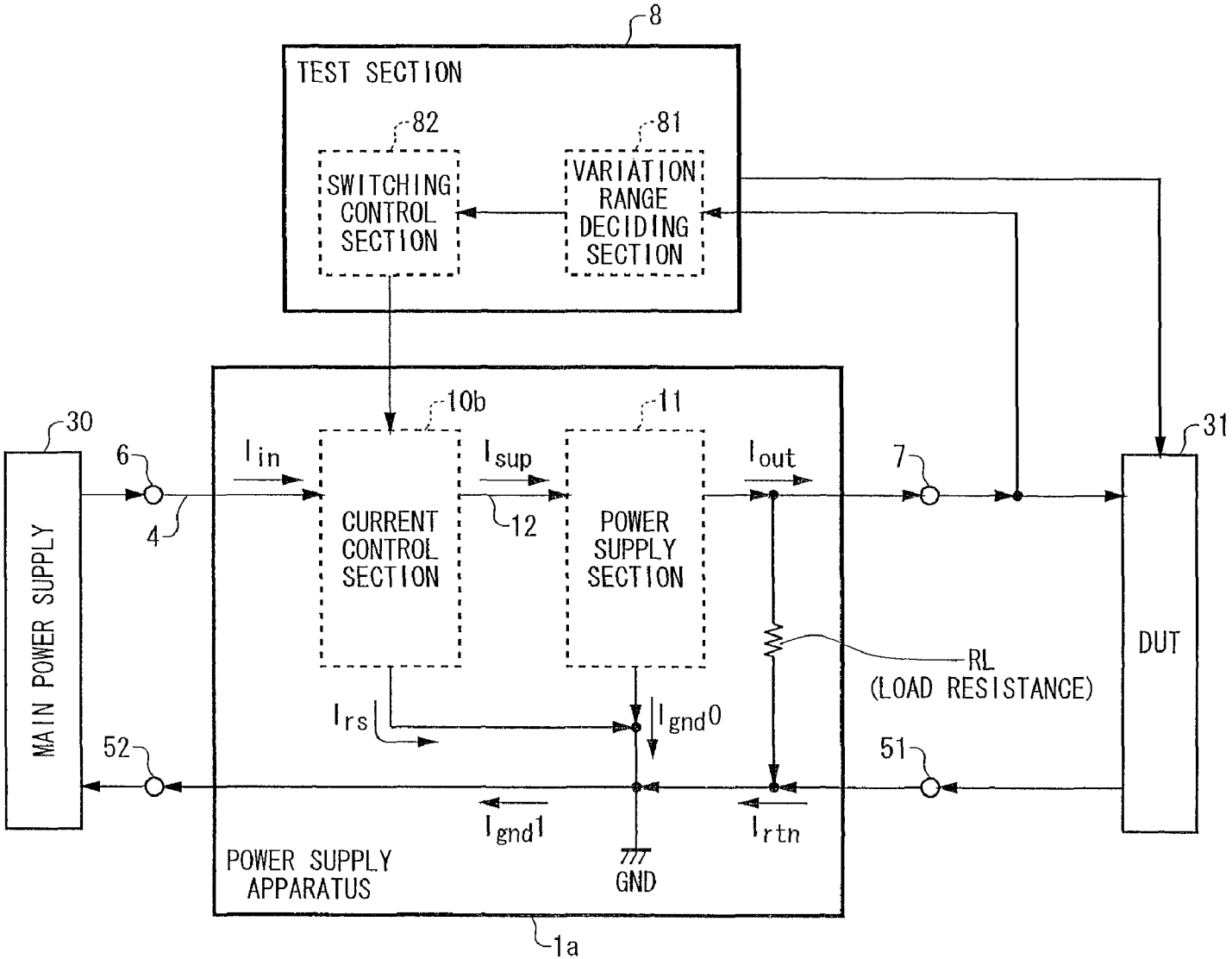
FIG. 7 shows a schematic configuration of a test apparatus including a power supply apparatus 1*a*, which further includes a peripheral apparatus according to Embodiment 2.

FIG. 7 shows a schematic configuration of a test apparatus including a power supply apparatus la and its peripheral apparatus as the second alternative example. The test apparatus shown in FIG. 7 is a test apparatus that includes the power supply apparatus (an electronic device) la, a main power supply 30, and a test section 8 and is connected to a device under test (DUT) 31 in order to test the DUT 31. The test apparatus shown in FIG. 7 is different from that of FIG. 1 of Embodiment 1 in that the external power supply apparatus 2 and the load 3 are replaced by the main power supply 30 and the DUT 31, the external current Iin is replaced by a main power supply current Iin, and the test section 8 is provided therein. The test section 8 is connected to the device under test 31, and transmits a signal or the like for testing an operation and performance of the device under test 31 to the device under test 31. The test section 8 includes a variation range deciding section 81 and a switching control section 82.

The variation range deciding section 81 inputs the output current Iout being output from the output current output terminal 7, decides whether a fluctuation range Wv of the output current Iout is within a predetermined fluctuation reference range Ws, and outputs a decision result to the switching control section 82. The switching control section 82 turns on the switch 106 for a test period for which the decision result of the fluctuation range Wv is not within the fluctuation reference range Ws and turns off the switch 106 for a test period for which the decision result of the fluctuation range Wv is within the fluctuation reference range Ws. The fluctuation reference range Ws, for example, determines a variation level, at which a current variation of the ground GND of the power supply section 11 starts generating spurious currents, from a value of the fluctuation range Wv of the output current Iout measured in the sample power supply apparatus la, and the variation level is previously stored on a storing section not shown as the fluctuation reference range Ws. Since the other components and operations are similar to those of the power supply apparatus 1 of Embodiment 1 shown in FIG. 1, their descriptions will be omitted.

Figure 8:
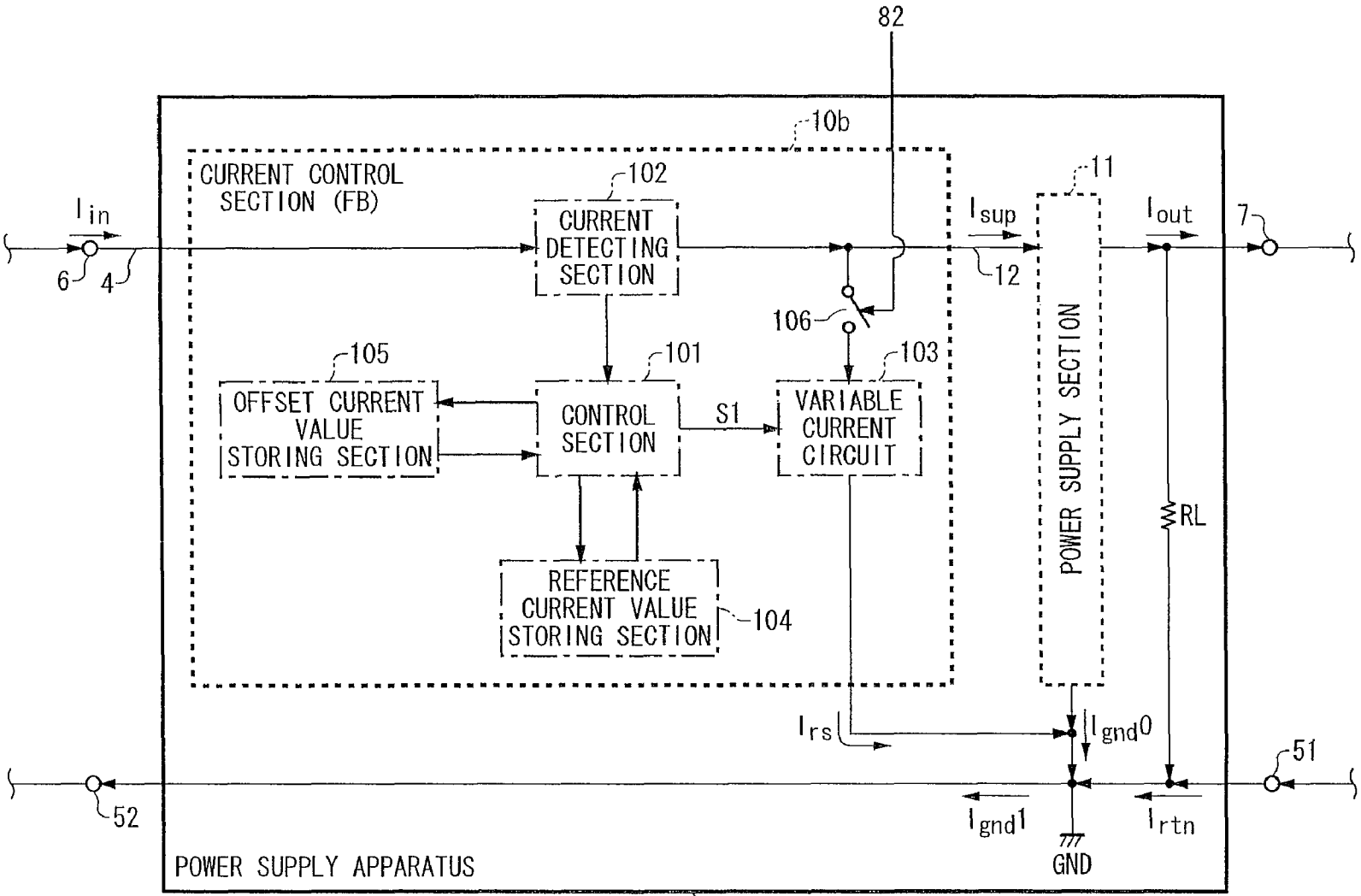
FIG. 8 shows a further detailed configuration of the test apparatus when the test apparatus shown in FIG. 7 controls electric currents in a configuration of a feedback method.

FIG. 8 shows a configuration of the power supply apparatus la when the power supply apparatus la has a feedback method. The current control section 10*b* of the power supply apparatus la includes a control section 101, a current detecting section 102, a variable current circuit 103, a reference current value storing section 104, and an offset current value storing section 105. The current control section 10*b* of FIG. 8 is different from that of FIG. 3 of Embodiment 1 in that the variable current circuit 103 and the switch 106 are serially connected between the current supplying line 12 and the ground GND of the power supply section 11 and the switch 106 is controlled by the switching control section 82. While the switch 106 is turned on, the variable current circuit 103 outputs the compensating current Irs from the current supplying line 12 to the ground GND of the power supply section 11. The control section 101 performs a control operation so that the main power supply current Iin detected by the current detecting section 102 in accordance with the control signal S1 approaches the preset reference current Iref. Since the other configuration and operation are similar to those of the current control section 10*b* of Embodiment 1 shown in FIG. 3, their descriptions will be omitted.

Figure 9A:
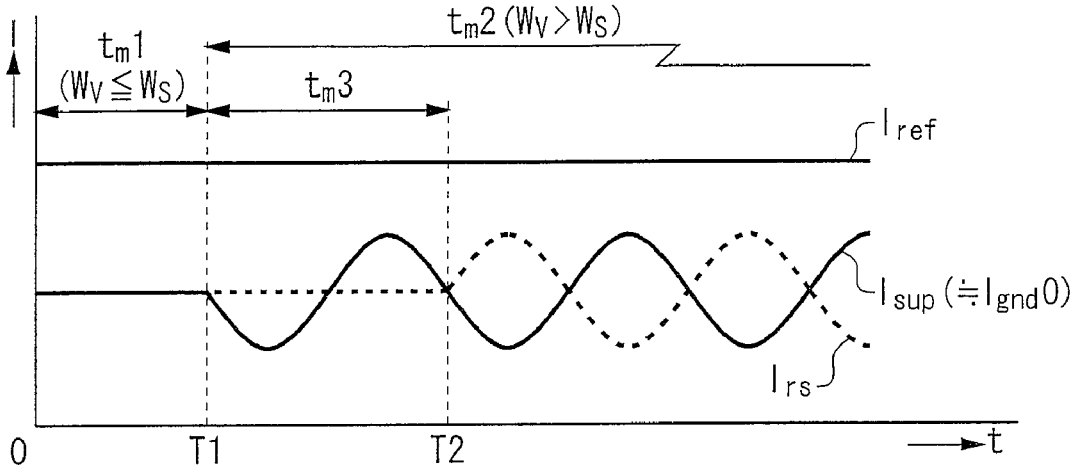
FIGS. 9A to 9C are graphs showing the fluctuation of GND electric currents in the test apparatus shown in FIG. 7.
Figure 9B:
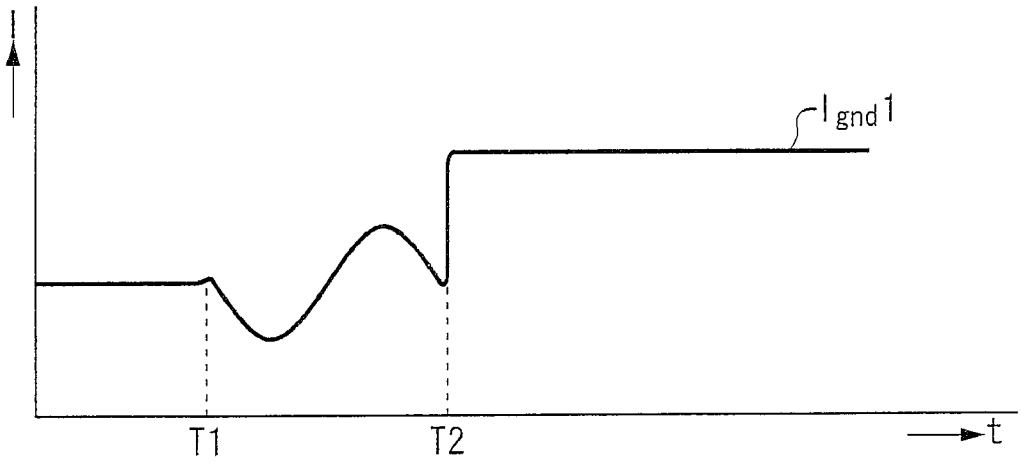
Figure 9C:
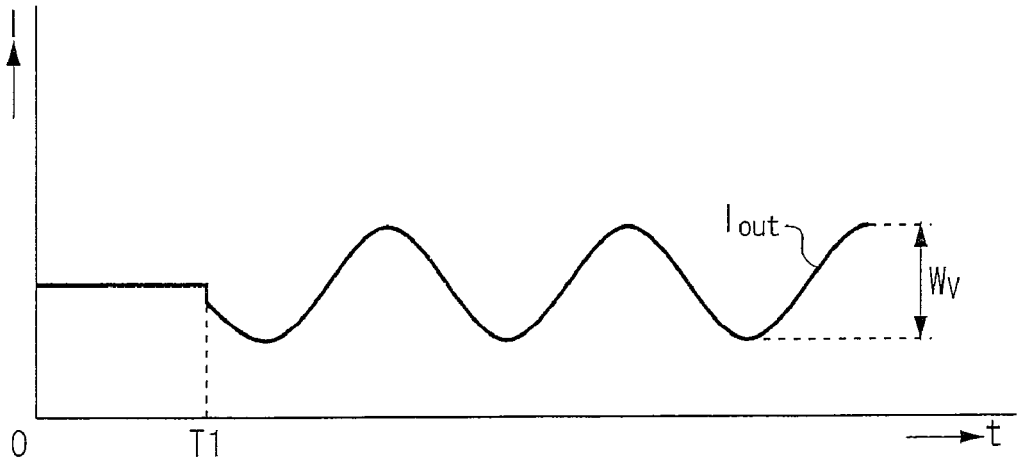

FIGS. 9A to 9C are graphs showing the fluctuation of GND electric currents in the test apparatus shown in FIG. 7. T1 of FIG. 9A shows a timing at which the output current Iout for test starts to be output to the device under test (DUT) 31. In a pretest period tm1 before the timing T1, both the supply current Isup and the compensating current Irs are steady values without fluctuation. A test period after the output current Iout is output at the timing T1 becomes tm2. In the test period tm2, for example, a decision period for which a maximum value and a minimum value of the fluctuation of the output current Iout are obtained becomes tm3. The variation range deciding section 81 judges whether the fluctuation range Wv of the output current Iout in the decision period tm3 is within the fluctuation reference range Ws. In the decision period tm3, the supply current Isup varies, but the compensating current Irs is a steady value without fluctuation. The decision period tm3 is obtained by, e.g., an experiment by a sample or simulation. T2 is a timing at which the decision period tm3 is ended and the variation range deciding section 81 judges whether the fluctuation range Wv is within the fluctuation reference range Ws. At the timing T2, the switching control section 82 turns off the switch 106 when the fluctuation range Wv is within the fluctuation reference range Ws and turns on the switch 106 when the fluctuation range Wv is outside the fluctuation reference range Ws.

In the decision period tm3 of FIG. 9B, the fluctuation based on the ground current Ignd0 in the ground GND is generated. However, after the timing T2 the fluctuation based on the ground current Ignd0 is compensated by the compensating current Irs, and thus the ground current Ignd1 has a steady value. In other words, after the timing T2, the compensating current Irs is not almost varied when the fluctuation range Wv is within the fluctuation reference range Ws. In FIG. 9C, even after the timing T2, the compensating current Irs is varied when the fluctuation range Wv is outside the fluctuation reference range Ws. Moreover, FIG. 9C shows that the fluctuation range Wv is obtained from a maximum value and a minimum value in the fluctuation of the output current Iout flowing from the power supply section 11 to the device under test 31 after the timing T1.

In this manner, in the test apparatus including the power supply apparatus 1*a* according to Embodiment 2, since the ground current Ignd1 obtained by adding the compensating current Irs varying in an antiphase has an approximately steady value even if the fluctuation of the ground current Ignd0 (return current value) in the ground GND of the power supply section 11 is large, the output current Iout being supplied from the power supply section 11 is stabilized and thus the precision of a test result can be raised. Moreover, the current control section 10*b* of FIG. 8 may determine a reference current and a reference offset current reference current as shown in FIGS. 4 and 5 and obtain a difference between the reference current and a supply current, in order to decrease the reference current Iref and thus decrease a consumption current.

Figure 10:
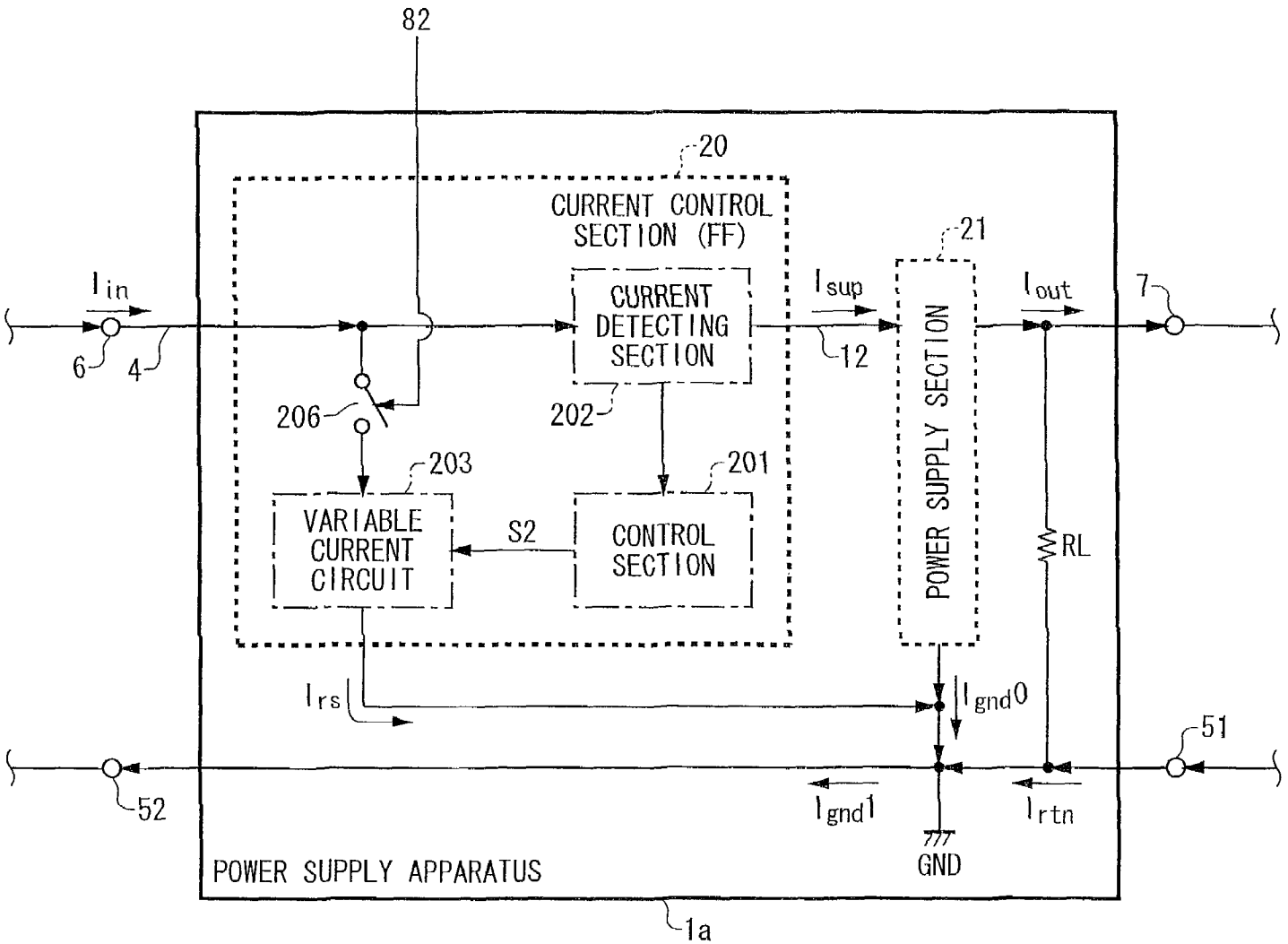
FIG. 10 shows a further detailed configuration of the test apparatus when the test apparatus shown in FIG. 7 controls electric currents in a configuration of a feed-forward method.

FIG. 10 shows a configuration of the power supply apparatus 1*a* when the power supply apparatus la has a feed-forward method as the third alternative example. In this case, the power supply apparatus 1*a* includes a current control section 20 and a power supply section 21. The current control section 20 includes a control section 201, a current detecting section 202, and a variable current circuit 203. The current control section 20 of FIG. 10 is different from FIG. 6 of Embodiment 1 in that the variable current circuit 203 and the switch 206 are serially connected between the external current line 4 and the ground GND of the power supply section 11 and the switch 206 is controlled by the switching control section 82. While the switch 106 is turned on, the variable current circuit 203 outputs the compensating current Irs from the external current line 4 to the ground GND of the power supply section 11. The switching of the switch in FIG. 10 is similar to when the switch 106 is replaced by the switch 206 in a configuration of a feedback method shown in FIG. 8. Moreover, since the other configuration and operation are similar to those of the current control section 20 of Embodiment 1 shown in FIG. 6, their descriptions will be omitted.

In this manner, the test apparatus including the power supply apparatus 1*a* according to the present alternative example can stabilize the output current Iout being supplied from the power supply section 11 and thus raise the precision of a test result even if the power supply apparatus la has a configuration of a feed-forward method as well as a feedback method. Moreover, the current control section 20 of FIG. 10 may determine a reference current and a reference offset current reference current as shown in FIGS. 4 and 5 and obtain a difference between the reference current and a supply current, in order to decrease the reference current Iref and thus decrease a consumption current.

Although the present invention has been described by way of an exemplary embodiment, it should be understood that those skilled in the art might make many changes and substitutions without departing from the spirit and the scope of the present invention. It is obvious from the definition of the appended claims that embodiments with such modifications also belong to the scope of the present invention.

As apparent from the above descriptions, according to an embodiment of the present invention, it is possible to realize a power supply apparatus, a test apparatus, and an electronic device that can stabilize an output current being supplied from a power supply section and thus raise the precision of a test result.

What is claimed is:

1. A power supply apparatus comprising:

a power supply section that receives a supply current and supplies an output current to an external load and a ground current to a ground; and a current control section that outputs the supply current to the power supply section and flows a compensation current varying in a phase opposite to the supply current being supplied to the power supply section into the ground of the power supply section, wherein a current obtained by adding the ground current, a feedback current from the external load, and the compensation current has an approximately steady value.

2. The power supply apparatus as claimed in claim 1, wherein the current control section flows an analog current varying in a phase opposite to the supply current into the ground of the power supply section.

3. The power supply apparatus as claimed in claim 2, wherein the current control section comprises:

a current detecting section that detects an external current being supplied from an external power supply apparatus connected to the power supply apparatus;

a variable current circuit that is connected between a current supplying line for supplying the supply current to the power supply section and the ground of the power supply section; and a control section that controls an electric current flowed by the variable current circuit from the current supplying line to the ground of the power supply section, in order to bring the external current detected by the current detecting section close to a preset reference current.

4. The power supply apparatus as claimed in claim 2, wherein the current control section comprises:

a variable current circuit that is connected between an external current line for inputting an external current being supplied from an external power supply apparatus connected to the power supply apparatus and the ground of the power supply section;

a current detecting section that detects the supply current; and a control section that controls the variable current circuit so that an electric current varying in a phase opposite to the supply current detected by the current detecting section flows from an external current input terminal to the ground.

5. The power supply apparatus as claimed in claim 3, wherein the control section flows an electric current obtained by subtracting the reference current from the external current from the current supplying line to the ground of the power supply section.

6. The power supply apparatus as claimed in claim 3, wherein the control section reduces the reference current, on condition that a value obtained by subtracting the supply current from the reference current is larger than a preset reference offset current, for a predetermined period.

7. The power supply apparatus as claimed in claim 3, wherein the control section increases the reference current on condition that a value obtained by subtracting the supply current from the reference current becomes smaller than a preset reference offset current.

8. A test apparatus that tests a device under test, the test apparatus comprising:

a test section that tests the device under test;

a power supply apparatus that supplies an output current to the device under test; and a main power supply that outputs a main power supply current for operating the power supply apparatus, and the power supply apparatus comprising:

a power supply section that receives a supply current and supplies the output current to the device under test and a ground current to a ground; and a current control section that outputs the supply current to the power supply section and flows a compensation current varying in a phase opposite to the supply current being supplied to the power supply section into the ground of the power supply section, wherein a current obtained by adding the ground current, a feedback current from the device under test, and the compensation current has an approximately steady value.

9. The test apparatus as claimed in claim 8, wherein the current control section comprises:

a current detecting section that detects a main power supply current being supplied from the main power supply; and a variable current circuit and a switch that are serially connected between a current supplying line for supplying the supply current to the power supply section and the ground of the power supply section; and a control section that controls an electric current flowed by the variable current circuit from the current supplying line to the ground of the power supply section, in order to bring the main power supply current detected by the current detecting section close to a preset reference current, and the test section:

disconnects the switch for a test period for which the output current being supplied to the device under test is fluctuated within a predetermined reference range; and connects the switch for a test period for which the output current being supplied to the device under test is fluctuated outside the reference range.

10. An electronic device comprising:

an electronic circuit;

a power supply section that receives a supply current and supplies an output current to the electronic circuit and a ground current to a ground; and a current control section that outputs the supply current to the power supply section and flows a compensation current varying in a phase opposite to the supply current being supplied to the power supply section into the ground of the power supply section, wherein a current obtained by adding the ground current, a feedback current from the electronic circuit, and the compensation current has an approximately steady value.

* * * * *